US011063356B2

(12) United States Patent
Arya et al.

(10) Patent No.: US 11,063,356 B2
(45) Date of Patent: Jul. 13, 2021

(54) LARGE APERTURE DEPLOYABLE REFLECTARRAY ANTENNA

(71) Applicant: CALIFORNIA INSTITUTE OF TECHNOLOGY, Pasadena, CA (US)

(72) Inventors: Manan Arya, Pasadena, CA (US); Jonathan Sauder, Pasadena, CA (US); Richard E. Hodges, Pasadena, CA (US); Sergio Pellegrino, Pasadena, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 35 days.

(21) Appl. No.: 16/434,111

(22) Filed: Jun. 6, 2019

(65) Prior Publication Data

US 2019/0393602 A1 Dec. 26, 2019

Related U.S. Application Data

(60) Provisional application No. 62/821,784, filed on Mar. 21, 2019, provisional application No. 62/687,373, filed on Jun. 20, 2018.

(51) Int. Cl.

| | |
|---|---|
| ***H01Q 3/46*** | (2006.01) |
| ***H01Q 1/28*** | (2006.01) |
| ***H01Q 15/16*** | (2006.01) |
| ***H01Q 21/00*** | (2006.01) |

(52) U.S. Cl.

CPC ..... *H01Q 3/46* (2013.01); *H01Q 1/288* (2013.01); *H01Q 15/161* (2013.01); *H01Q 21/0018* (2013.01)

(58) Field of Classification Search

CPC ..... H01Q 1/08; H01Q 1/28; H01Q 1/288; H01Q 3/46; H01Q 15/161; H01Q 21/0018

See application file for complete search history.

(56) References Cited

U.S. PATENT DOCUMENTS

| | | | | |
|---|---|---|---|---|
| 6,828,949 | B2 * | 12/2004 | Harless | H01Q 15/161 343/912 |
| 7,474,273 | B1 * | 1/2009 | Pavliscak | H01Q 1/366 343/754 |
| 8,289,221 | B1 * | 10/2012 | Finucane | H01Q 21/065 343/781 R |
| 8,390,531 | B2 * | 3/2013 | Maruyama | H01Q 3/46 343/912 |
| 9,583,839 | B2 * | 2/2017 | Liu | H01Q 15/0026 |

(Continued)

OTHER PUBLICATIONS

Arya M. "Packaging and Deployment of Large Planar Spacecraft Structures" Ph.D. thesis, California Institute of Technology, 2016, 131 pages.

(Continued)

*Primary Examiner* — Dimary S Lopez Cruz
*Assistant Examiner* — Patrick R Holecek
(74) *Attorney, Agent, or Firm* — Steinfl + Bruno LLP

(57) ABSTRACT

A deployable reflectarray has a plurality of strips arranged in quadrants forming the reflectarray. The copper ground plane and the copper dipoles are supported by facesheets made of epoxy reinforced by quartz fibers. The copper ground plane is separated from the copper dipoles by S-shaped springs made of epoxy reinforced by quartz fibers, which allow folding and deployment of the reflectarray.

20 Claims, 12 Drawing Sheets

(56) References Cited

U.S. PATENT DOCUMENTS

2010/0060546 A1* 3/2010 Robson ..... H01Q 3/02 343/912
2016/0376037 A1* 12/2016 Pellegrino ..... B64G 1/428 244/159.4

OTHER PUBLICATIONS

Arya M. et al., "Crease-free biaxial packaging of thick membranes with slipping folds," International journal of Solids and Structures, vol. 108, 2017, pp. 24-39 16 pages.
Arya M. et al., "Large-Area Deployable Reflectarray Antenna for CubeSats" Spacecraft Structures Conference, AIAA SciTech Forum, 2018, 12 pages.
Arya M. et al., "Ultralight structures for space solar power satellites," 3rd AIAA Spacecraft Structures Conference, 2016 18 pages.
Banik J.A. et al., "Performance Validation of the Triangular Rollable and Collapsible Mast," 24th Annual AIAA/USU Conference on Small Satellites, 2010 8 pages.
Chahat N.E. et al., "CubeSat Deployable Ka-Band Mesh Reflector Antenna Development for Earth Science Missions," *IEEE Transactions on Antennas and Propagation*, vol. 64, No. 6,2016, pp. 2083-2093 11 pages.
Chahat N.E., et al., "One Meter Deployable Reflectarray Antenna for Earth Science Radars," 2017 IEEE Antennas arid Propagation Society International Symposium Proceedings, 2017 2 pages.
Gao S. et al., "Advanced Antennas for Small Satellites," Proceedings of the IEEE, vol. 106, No. 3, 2018, pp. 391-403 13 pages.
Hodges R.E. et al., "A Deployable High-Gain Antenna Bound for Mars: Developing a new folded-panel reflectarray for the first CubeSat mission to Mars," IEEE Antennas and Propagation Magazine, vol. 59, No. 2, 2017, pp. 39-49 11 pages.
Hodges R.E, et al., "Novel Deployable Reflectarray Antennas for CubeSat Communications," 2015 IEEE MTT-S International Microwave Symposium, IMS 2015, 2015 4 pages.
Hodges R.E. et al., "The ISARA Mission-Flight Demonstration of a High Gain Ka-Band Antenna for 100Mbps Telecom," AIAA/USU Conference on Small Satellites, 2018 6 pages.
Johnson L. et al., "NanoSail-D: A solar sail demonstration mission," Sixth IAA Symposium on Realistic Near-Term Advanced Scientific Space Mission, 2009 5 pages.
Kelly P.K. "A Scalable Deployable High Gain Antenna—DaHGR" AIAA/USU Conference on Small Satellites, 2016 7 pages.
Schlothauer A. et al., "Flexible Silicone Molds for the Rapid Manufacturing of utra-thin Fiber Reinforced Structures" Society for the Advancement of Material and Process Engineering, 2018 15 pages.
Warren P.A. et al., "Large, Deployable S-Band Antenna for a 6U CubeSat," 29th Annual AIAA/USU Conference on Small Satellites, 2015 7 pages.

* cited by examiner

LARGE APERTURE DEPLOYABLE REFLECTARRAY ANTENNA

CROSS REFERENCE TO RELATED APPLICATIONS

The present application claims priority to U.S. Provisional Patent Application No. 62/687,373, filed on Jun. 20, 2018, and U.S. Provisional Patent Application No. 62/821,784, filed on Mar. 21, 2019, the disclosures of both being incorporated herein by reference in their entirety.

STATEMENT OF INTEREST

The invention described herein was made in the performance of work under a NASA contract NNN12AA01C, and is subject to the provisions of Public Law 96-517 (35 USC 202) in which the Contractor has elected to retain title.

TECHNICAL FIELD

The present disclosure relates to antennas. More particularly, it relates to a large aperture deployable reflectarray antenna.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

SUMMARY

Figure 1:
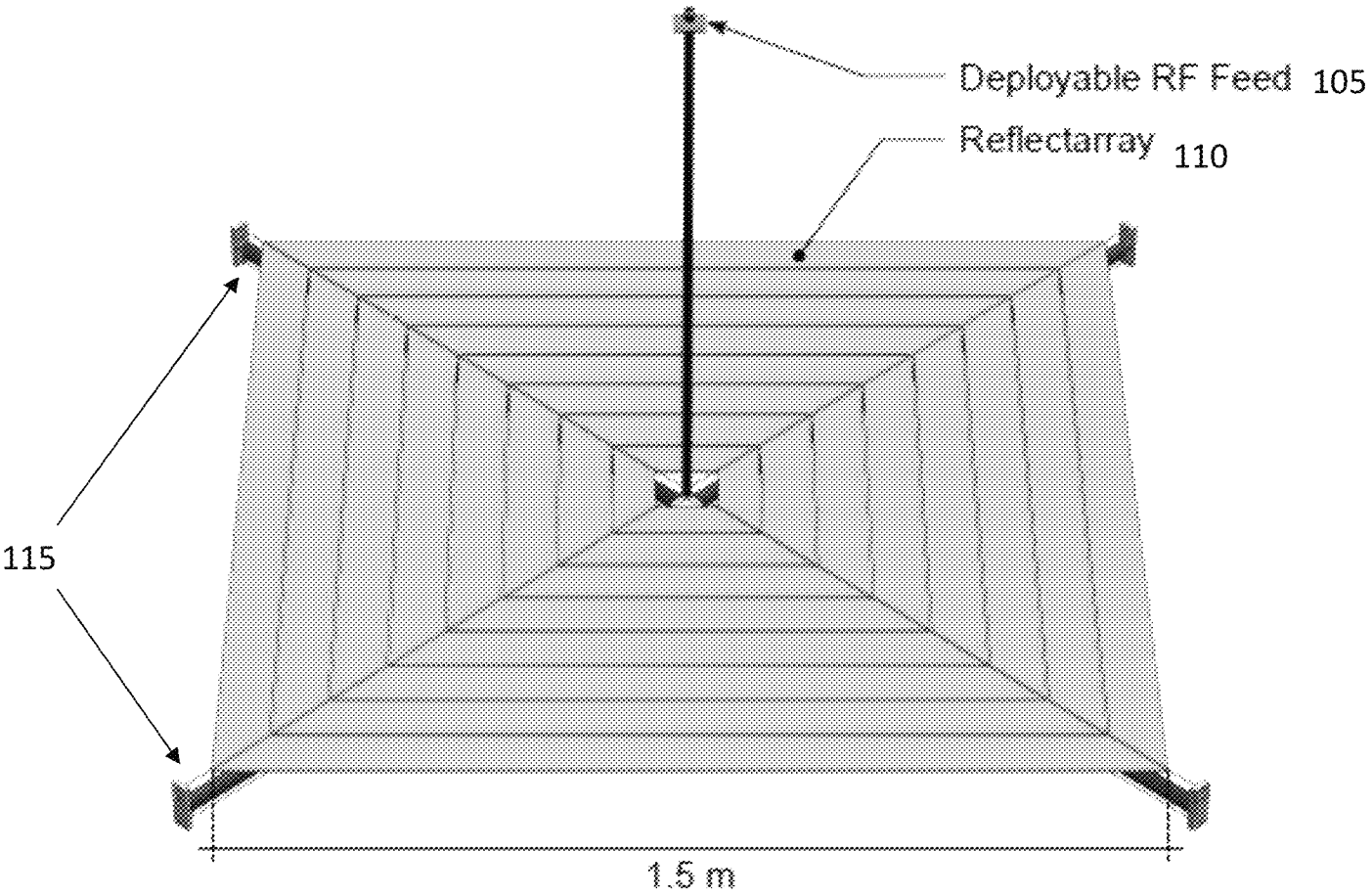
FIGS. 1-2 illustrate an overview of the Large-Area Deployable Reflectarray (LADeR).

In a first aspect of the disclosure, a method is described, the method comprising: deployable reflectarray antenna comprising: a plurality of deployable booms; a radio frequency feed; and a reflectarray supported by the plurality of deployable booms and configured to: be stored in a folded configuration within a satellite bus, and deploy out of the satellite bus into a deployed configuration during operation of the satellite, the reflectarray comprising: a plurality of strips, each strip of the plurality of strips comprising: a conductive ground plane; a first facesheet attached to the conductive ground plane; a second facesheet; a plurality of conductive dipoles attached to the second facesheet; a plurality of collapsible S-shaped springs attached to the first facesheet and to the second facesheet, and being configured to: collapse during folding of the reflectarray, thus allowing adjacent facesheet to fold against each other in the folded configuration, and provide mechanical support for the reflectarray in the deployed configuration, separating adjacent facesheet; and a plurality of ligaments joining adjacent strips of the plurality of strips.

DETAILED DESCRIPTION

The present disclosure describes large-area deployable reflectarray antennas for CubeSats applications. In particular, the present disclosure describes, as an exemplary embodiment, a 1.5 m×1.5 m reflectarray antenna designed to stow in a cylinder with a diameter of 20 cm and a 9 cm height, and then be unfolded to provide an aperture suitable for radio frequency (RF) operations at the X-band (e.g. 8.4 GHz) while producing 39.6 dB of gain or better. In the following, parameters for the exemplary embodiment will be described; however, the person of ordinary skill in the art will understand that in other embodiments some of these parameters may be different. The mass of the reflectarray can be, for example, 1.75 kg. The reflectarray can comprise a number of crossed-dipoles held 5 mm above a ground plane. While in some embodiments the dipole elements are symmetrical crosses, in other embodiments the elements may be asymmetrical crosses with unequal lengths in the perpendicular arms, which allow independent scans or shaping of the horizontal and vertical polarization patterns. In yet other embodiments, elements may have other shapes, such as, for example, rings, loops, concentric rings, double loops, and others. The dipole layer and the ground plane are each supported by thin planar composite facesheets; the separation between these facesheets is provided by thin composite collapsible 'S'-shaped-springs. The structure is divided into a number of quartz-epoxy composite strips arranged in concentric squares and connected to each other using slipping folds. The strips can be flattened, star-folded (folded in the shape of a star), and wrapped to package within the compact cylindrical volume. A full-scale prototype of this reflectarray was constructed and tested. Stowage in the design volume was successfully demonstrated, and all RF performance requirements were met, as shown by a pre-stowage RF test and a post-stowage RF test.

Large radio frequency (RF) apertures for small satellites such as CubeSats enhance the capabilities of small spacecraft by enabling higher data rate telecommunications and higher performance remote sensing instruments. Since the launch volume of CubeSats is limited, deployable apertures are used. Several deployable RF CubeSat apertures have been developed, to varying levels of technological maturity. Two mechanical design architectures are dominant for deployable RF reflectors for small satellites: parabolic mesh antennas (e.g. KaPDA for RainCube, KaTENna), and planar reflectarrays (e.g. ISARA, the MarCO High-Gain Antenna, OMERA, DaHGR). A key example of a CubeSat RF aperture that is not a reflector is the S-band 1.24×1.24 $m^2$ patch array of antennas developed as described in Ref [1], the disclosure of which is incorporated by reference in its entirety.

The present disclosure describes even larger apertures, to demonstrate the next generation of stowable planar reflectarray technology. One embodiment described in the present disclosure is capable of providing a 1.5×1.5 $m^2$ aperture that can be stowed in a cylindrical volume of 20 cm diameter and 9 cm height. Therefore, this reflectarray could be stowed in a 4U CubeSat volume. A 'U' or a CubeSat unit refers to a cubical volume with 10 cm sides. Additional volume will be required for the stowage of associated deployment hardware e.g. booms.

Figure 2:
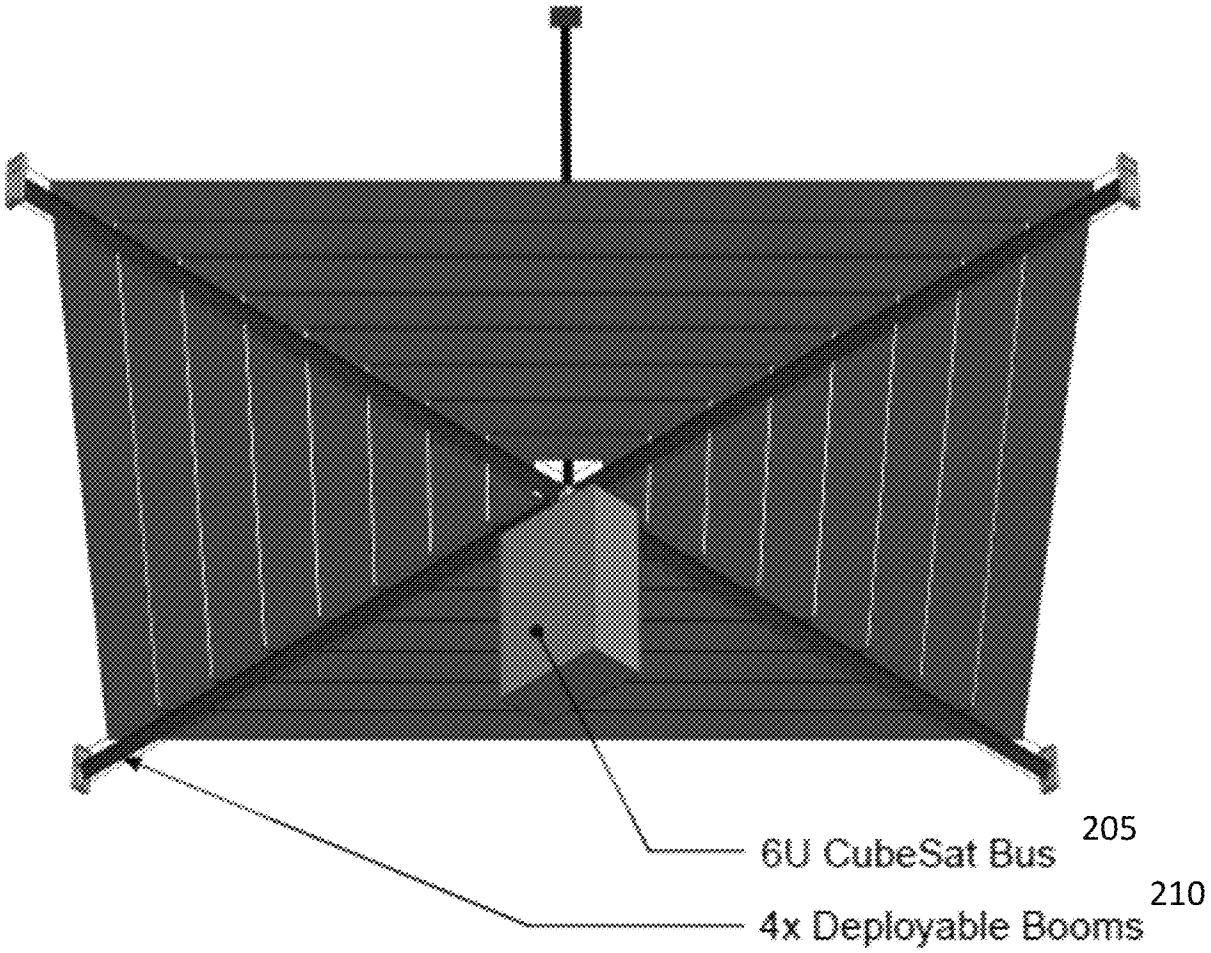

FIGS. 1-2 illustrate an overview of the Large-Area Deployable Reflectarray (LADeR) according to one embodiment as described in the present disclosure. As visible in FIG. 1, the reflectarray (110) is supported by four deployable booms (115) and connected to the CubeSat bus. A deployable RF feed (105) is attached to the CubeSat bus, as well. FIG. 2 illustrates the CubeSat bus (205) and the four deployable booms (210). The reflectarray is deployed from the bus, and during deployment the booms extend the reflectarray to fully extend in the position illustrated in FIGS. 1-2. FIG. 1 illustrates a top view of the reflectarray, while FIG. 2 illustrates a bottom view.

The present disclosure describes the design of the reflectarray subsystem. The supporting booms and the deployable feed may be adapted from existing designs known to the person of ordinary skill in the art (e.g. deployable TRAC booms on NanoSail-D). The autonomous and controlled deployment of the reflectarray using known deployable mechanisms will also be readily understood by the person of ordinary skill in the art.

The present disclosure focuses on the innovative RF design for the reflectarray, and on the innovative substrate that supports the reflectarray. The substrate is a collapsible structure that is lighter and more compactable than the solid substrates known to the person of ordinary skill in the art, such as the MarCO high gain antenna (HGA) and ISARA. The innovative substrate is also stiffer and capable of a higher degree of planarity than the creased polymer membrane substrates described for example in Ref [1] and used for DaHGR.

Figure 3:
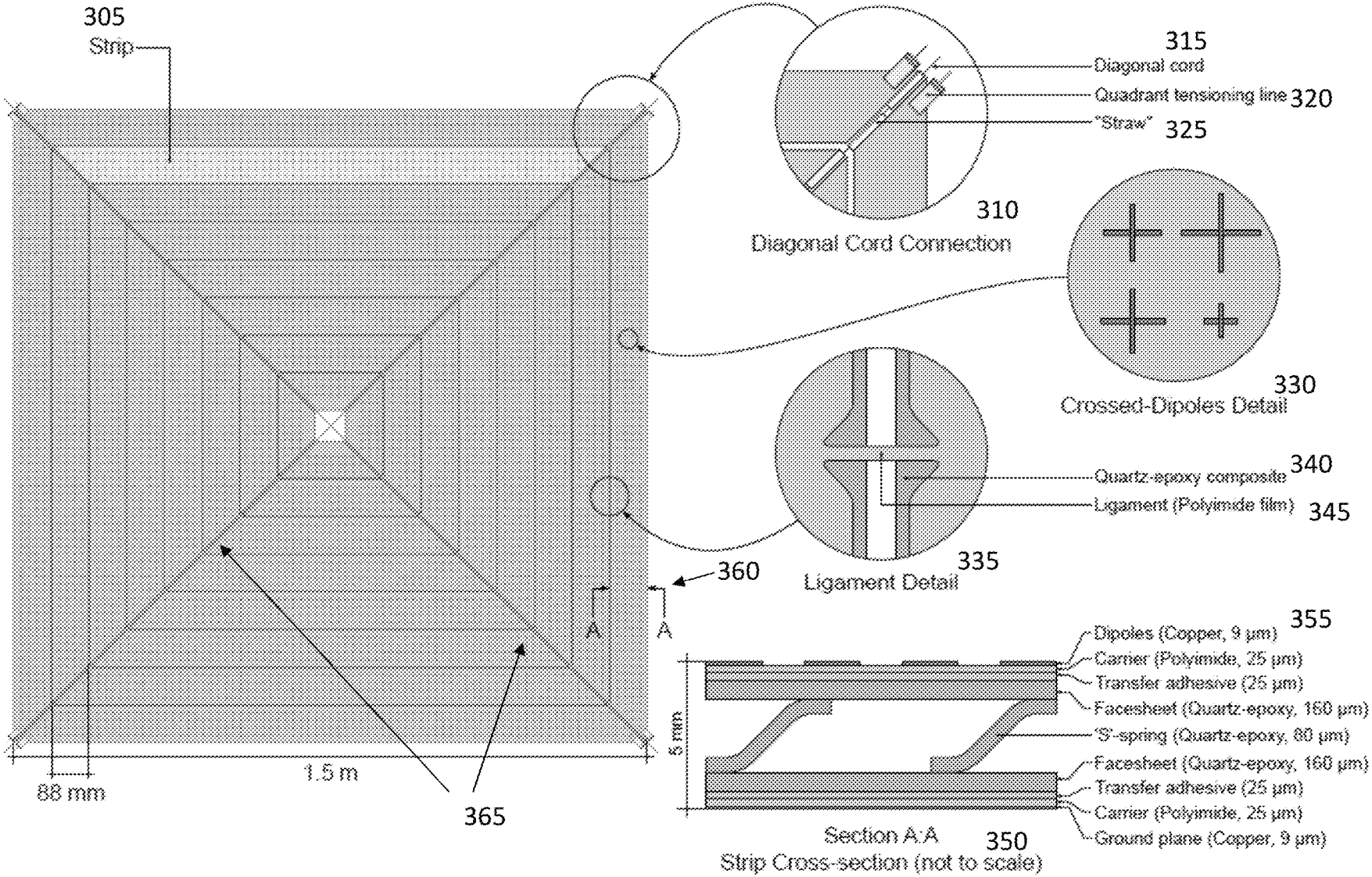
FIG. 3 illustrates strips forming the reflectarray.

FIG. 3 illustrates an overview of the reflectarray, with zoomed in highlights of a single strip. The reflectarray comprises multiple strips in different orientations to form the complete shape. In some embodiments, the reflectarray comprises 4340 cross-dipole elements spaced 22.5 mm apart in a rectangular lattice that forms a 1.5×1.5 m reflector as illustrated in FIG. 3.

FIG. 3 illustrates multiple strips, such as strip (305), which has a width of 88 mm. The reflectarray has a 1.5 m edge. A zoomed in view of a corner shows a diagonal cord connection (310), illustrating a diagonal cord (315), a quadrant tension line (320) and a 'straw' (325). A zoomed in view of a strip shows a detail of the dipoles shaped like crosses of different size (330). Another zoomed in detail shows a ligament (335) which joins adjacent strips, comprising a quartz epoxy composite (340) and the ligament proper (345) made of a polyimide film. A side view shows a cross section of a strip (350), taken across points A-A (360). The cross section shows a plurality of layers (355): dipoles made of 9 micrometer thickness copper; a carrier made of 25 micrometers of polyimide; a transfer adhesive of 25 micrometers; a facesheet of quartz epoxy of 160 micrometers; an S-shaped spring made of quartz epoxy 80 micrometers thick, though in other embodiments the S-springs are 160 micrometers thick; a lower facesheet of quartz epoxy of 160 micrometers; a transfer adhesive of 25 micrometers; a carrier of polyimide of 25 micrometers; and a ground plane of copper 9 micrometers thick.

The reflector is illuminated by a feed placed at the focal point one meter above the reflector surface, along the central reflector axis, resulting in an F/D of 0.67. The dipoles lengths are adjusted in order to change the phase of the reflected signal, thereby collimating the energy that emanates from the feed. Packaging to fit on a spacecraft as illustrated in FIG. 2 requires a small feed and subreflector assembly mounted to a telescopic waveguide deployment mechanism. However, the present disclosure focuses on describing the deployable reflector. Therefore, a small pyramidal horn is used as a stand in for a full telescopic waveguide deployable mechanism, with a 10 dB beamwidth of approximately 74°. The design of a combined feed and subreflector that provides similar illumination and has already been developed as described for example in Ref [2].

The copper cross-dipole elements are photo etched on 25 micrometer thick polyimide sheets bonded to a quartz epoxy facesheet, an AstroQuartz™ (AQ) facesheet, as shown in the cross section (350) of FIG. 3. These AQ sheets are supported above a copper ground plane using 'S'-springs. The details of this construction are described below in the present disclosure. An important practical consideration in this design is that the fabrication process, in some embodiments, does not provide high-precision tolerances in several key dimensional parameters. Therefore, in some embodiments, knowledge of the material dielectric constants may not be highly accurate. To accommodate this, cross-dipole elements are placed 5 mm above the ground plane. Dielectrics in close contact with a cross-dipole element have a strong "loading" effect that will influence their resonant frequency, but this dielectric loading effect decays very rapidly as the dielectric sheets are moved away from the dipole. By supporting the dipoles on thin sheets, the dipoles are primarily influenced by the well-controlled properties of the polyimide layer, while other dielectrics have less impact. Also, the relatively large 5 mm dipole-to-ground plane separation was selected to provide a good range of achievable phase shifts while being relatively insensitive to dimensional tolerance. Consequently, this arrangement provides a robust, low-mass-density design that minimizes RF dielectric losses.

The reflectarray structure provides two planar parallel surfaces, separated by 5 mm, on which the antenna dipole layer and the ground plane reside. This separation is given by the basic structural unit of this reflectarray, which is a strip. As shown in cross section (350), a strip comprises two facesheets separated by a number of collapsible 'S'-shaped springs. Each facesheet is 160 micrometers thick, and is made of epoxy reinforced with woven quartz fabric. The 'S'-springs are 160 micrometers thick, and also made of the quartz-epoxy composite material. The antenna dipoles and ground plane, each comprising a layer of copper supported by a carrier layer of polyimide film, are adhered to the quartz-epoxy composite structure using transfer adhesive. In some embodiments the transfer adhesive is not necessary as the polyimide carrier can be co-cured with the reinforced fabric.

Because of its out-of-plane depth, a strip has substantial out-of-plane bending stiffness. This strip bending stiffness contributes to the stiffness of the overall array and is important in maintaining the planarity of the reflectarray. Additionally, the cross-section of a strip allows it to be flattened elastically for packaging. An 'S'-spring consists of three flat sections connected by two transversely curved sections; the two transversely curved sections flex during flattening. The radius of curvature of the transversely curved sections is 5 mm, which ensures that the flattening strain on the 'S'-springs is less than 1.6%, which is within the elastic regime of the strip material. The flattening strain can be calculated as half the thickness of the 'S'-springs, 160 micrometers, divided by the change in transverse radius, 5 mm.

The strip material, epoxy resin reinforced with woven quartz fibers, was chosen for its dielectric properties, its heritage in space reflector structures, its toughness, and its strength. Specifically, Patz™ PMT-F4 (a 120° C. cure epoxy resin) and plain weave AstroQuartz™ II 525 were used. The fiber layups are as follows: two plies arranged in a 0°/90° stack for the facesheets, two plies arranged in a 0°/90° orientation for the 'S'-springs; 0° is defined as being along the length of the strip in this system.

The antenna dipoles and the ground plane consist of a DuPont™ Pyralux™ material; this material comprises a layer of 25 micrometers thick polyimide film clad with a layer of 9 micrometers thick copper. The antenna dipoles were manufactured by a photolithography process, selectively chemically etching away the copper layer, leaving the desired arrangement of dipoles intact. The dipole layer and the ground plane were attached to the strip quartz-epoxy substrate using transfer adhesive, which was roughly 25 micrometers thick.

As shown in FIG. 3, the strips are arranged in concentric squares. Two diagonal lines (365) divide the array into four mechanically identical quadrants. In each quadrant, there are eight strips. Each strip is 88 mm in width; the length of the strip varies from 1.5 m at the outer edge of the array to 60 mm at the inner edge near the center. There are 2 mm gaps between the strips, which allow for a structural connection to exist between the strips. This specific arrangement of the strips is designed to allow for the stowing of the reflectarray, as further explained below in the present disclosure.

The structural architecture of this reflectarray improves on previous disclosures as described in Refs. [3,4]. The strips, each of which has non-negligible out-of-plane bending stiffness, are "hung" on two pretensioned cords that run along the diagonals of the reflectarray. These diagonal cords are pretensioned by deployable booms as shown in FIG. 2; in the experiments described herein, the booms were substituted for a non-deployable cross of PVC tubing. The structural connection between a strip and a diagonal cord consists of a "straw" of fabric tubing that is attached to the end of the strip; the tensioned diagonal cord passes through this "straw". In a prototype, the diagonal cords were realized as braided Kevlar™ threads, tensioned by tightening a turnbuckle engaged in series with the cord.

In addition to the diagonal cords, the strips within a quadrant are also connected to each other through slipping folds. This type of fold allows for both rotation about and translation along the hinge axis. In this reflectarray, these slipping folds are realized as a number of ligaments between the strips as illustrated in FIG. 3. To enable creaseless folding, the Pyralux™ material is mostly cut between the strips; the ligaments are lengths of uncut Pyralux™. This allows for the relative folding and sliding of strips that is required for packaging, but maintains a degree of structural connectivity between the strips.

From a structural perspective, this reflectarray reacts to in-plane loads through the in-plane tensile and compressive stiffness of the strips, and the pre-tension in the diagonal cords. Out-of-plane loads are reacted to by the out-of-plane stiffness of the strips, and the pre-tension in the diagonal cords. Refs. [3,4] describe analytical and numerical models for predicting the stiffness of such structures. When deployed, the structure is sufficiently stiff to maintain its shape in a 1 g environment (positioned vertically, so gravity acts in the plane of the structure) without any gravity-offloading mechanisms. The mass of the prototype reflectarray was measured to be 1.75 kg; this corresponds to an areal density of 0.78 kg/m$^2$.

Figure 4:
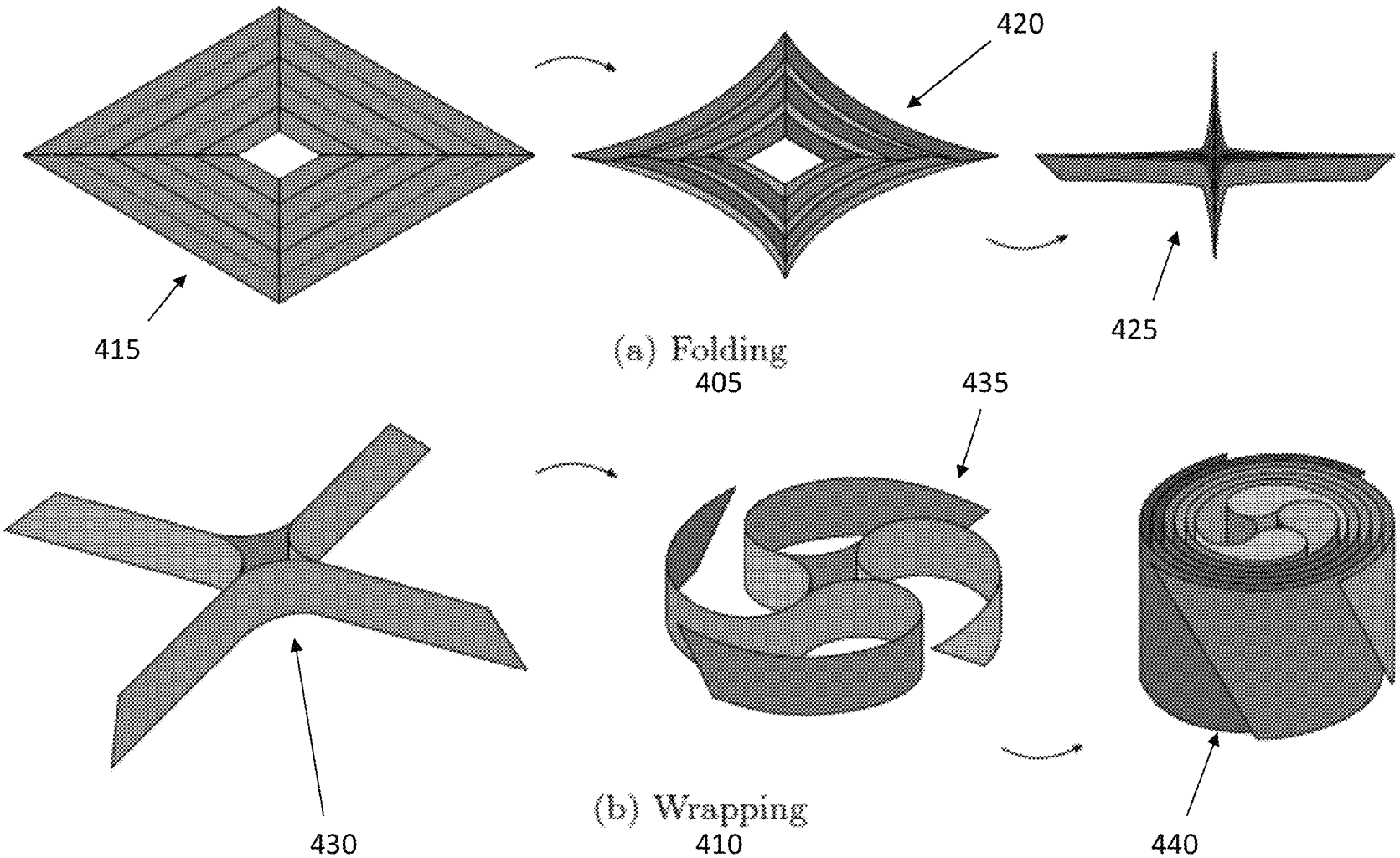
FIG. 4 illustrates wrapping of the strips.

The packaging methodology improves on previous work on slip-wrapping as described in Refs. [3-5]. The strips are connected by slipping hinges that allow the strips to rotate about and translate along the hinge axis. This allows the strips to be star-folded, and then wrapped into a compact form, as shown in FIG. 4. In the embodiment of FIG. 4, the structures use 5 strips per quadrant, but in other embodiments the reflectarray design has a different number of strips per quadrant, such as 8 strips per quadrant. The general packaging methodology, however, is unchanged: the strips are first flattened and folded into a star-like configuration with 4 arms, and the arms are then wrapped around each other. The folding of the strips is concurrent with the flattening of the strips. This flattening is important, as without it, the strips would be unable to wrap tightly.

The slipping hinges allow the strips to slip with respect to each other during wrapping. This slip is required to accommodate the finite (non-zero) thickness of the flattened strip. By restricting the minimum radius $R_{min}$ during wrapping (and thus the maximum curvature), the strains during wrapping can be restricted to be within the elastic range of the material. Thus the packaging can be an entirely elastic process, with no permanent damage or deformation of the strip structure. This allows the reflectarray to return to its original shape after deployment.

FIG. 4 illustrates the folding steps (405) and the wrapping steps (410). The strips are flattened into a plane (415), then folded in a star shape (420). The strips can rotate relative to each other thanks to the space separating the strips, and the connections between strips allowing the strips to rotate relative to the adjacent ones. This allows folding of the strips into a tighter star configuration (425) as the surfaces of adjacent strips are folded against each other. Once the folding has been completed (430), a star shape is obtained, comprising 4 arms, each arm including multiple strips folded together. The arms of the star shape can then be wrapped in a circular direction, all arms being wrapped in the same direction, such as clockwise when viewed from the top in FIG. 4 (435). When the wrapping is completed (440) a cylindrical compact shape is obtained. A top view of the cylindrical compact shape (440) is shown in FIG. 5.

Figure 5:
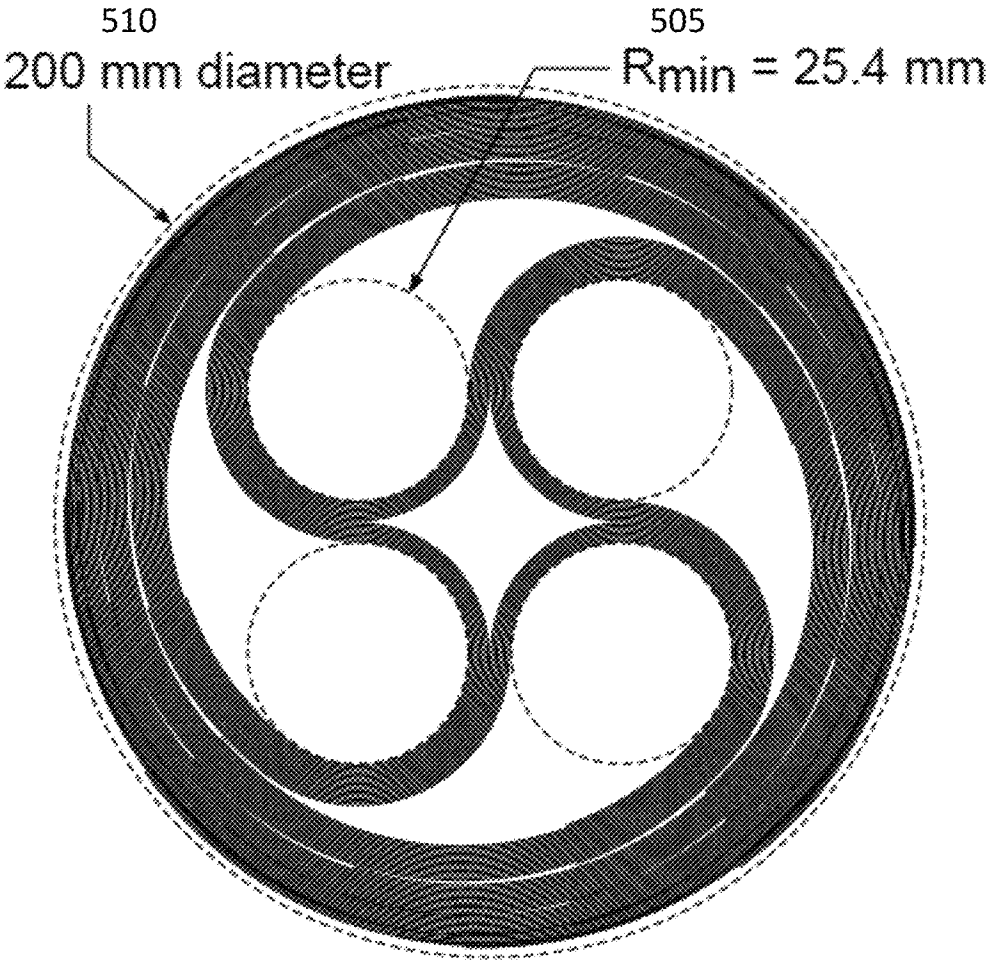
FIG. 5 illustrates a predicted wrapped cross-section of the reflectarray.

FIG. 5 illustrates the predicted wrapped cross-section of this reflectarray for a minimum wrapping radius of 25.4 mm (505). Given the measured flattened strip thickness of 610 micrometers, the maximum strain in the wrapped strips can be estimated as half the thickness divided by the radius, which is 1.2%. This value well below the compressive failure strain of the quartz-epoxy composite material of 1.9%. The predicted wrapped form of the reflectarray in FIG. 5 was generated by an algorithm described in Ref [4] that models the wrapped strips as parallel spiral curves, separated from each other by distances to account for the non-zero material thickness. The diameter illustrated in FIG. 5 is 200 mm (510).

Figure 6:
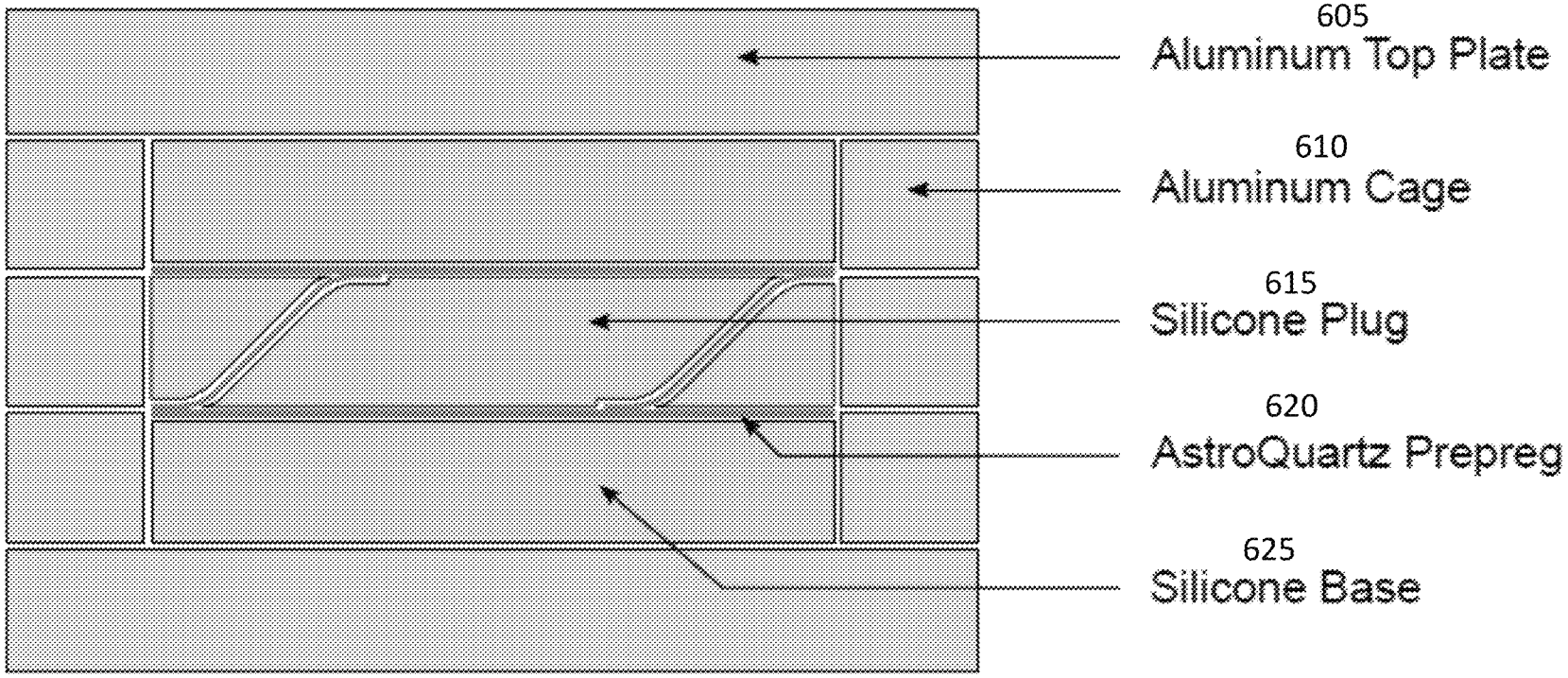
FIG. 6 illustrates a cross-section of the molds used to fabricate a strip substrate.

The quartz-epoxy substrate of each strip was manufactured in 1.5 m lengths in a single-cure process in an oven as described in Ref [15]. Plain weave AstroQuartz™ (AQ) II 525 was impregnated with Patz™ PMT-F4 epoxy resin at roughly 40% resin content. The AQ prepreg was laid up in the desired configuration, with five custom-made silicone molds supporting the AQ prepreg, as shown in FIG. 6. The silicone molds and the AQ were held in a five-piece aluminum encasement, held together with steel bolts. This encasement was necessary to constrain the high-coefficient-of-thermal-expansion (CTE) silicone molds during the 120° C. cure. Also because of this high CTE, the silicone expansion against the aluminum encasement provided sufficient pressure to cure the epoxy in the prepreg. As such, even though this process was conducted in an autoclave, the pressurization functionality of the autoclave was not required, and the autoclave functioned merely as an oven. In other embodiments, fabrication activities could be carried out in long ovens, as opposed to autoclaves. FIG. 6 illustrates a cross-section of the molds used to fabricate a strip substrate. FIG. 6 illustrates the aluminum top plate (605), and cage (610) which form the aluminum encasement, as well as the quartz epoxy material (620) which forms the AQ facesheets and the S springs described in FIG. 3, the silicone base (625) and silicone plug (615).

In this embodiment, 20 lengths of strip substrate, each 1.5 m long, were manufactured. These lengths were then cut into the required shapes, forming the 32 strips of lengths ranging from 0.24 m to 1.50 m. Once cut into the desired shapes, a layer of Pyralux™ was attached to the bottom facesheet of the strips using transfer adhesive. This formed the ground plane for each strip. The ground plane is not continuous across all strips; separate trapezoids of Pyralux™ were attached to the bottom facesheet of each strip. Pyralux™ AC 092500EV was used for both the ground plane and the dipole layer.

To form the dipole layer, eight separate sheets (two sheets per reflectarray quadrant) of Pyralux™ were photolithographically etched. A laser cutter was also used to cut the sheets to size and to cut the ligaments into the material. For each quadrant, the two dipole layer sheets of etched and cut Pyralux™ were laid flat on a table, and the strip substrates were attached to the sheets using transfer adhesive.

The "straws" that connect the ends of the strips to the diagonal cords were 50 mm long segments of flexible electrical-insulating sleeving made of woven fiberglass coated with acrylic plastic. These straws were about 3.3 mm in outer diameter, and flexible enough to fold and wrap with the strips. A straw was attached to either end of a strip using fabric-reinforced adhesive tape. The diagonal cords, made of a braided Kevlar™ thread, were passed through these straws.

For the RF tests, the reflectarray was held in a deployed state using a cross made of 1-inch-diameter PVC tubing to simulate the four deployable booms shown in FIG. 2. This cross was then mounted on an aluminum framing. Turnbuckles were used to tension the diagonal cords to an appropriate level, roughly 10 pounds of tension.

The prototype reflectarray was tested for RF performance and for packaging. The first RF test, RF Test 1, was performed before the prototype was packaged; this test was designed to evaluate the RF performance of a pristine (i.e. unfolded) reflectarray. Following RF Test 1, the reflectarray was stowed and deployed for Packaging Test 1. A second RF test, RF Test 2, was then performed to evaluate changes in RF performance due to the packaging process. Then, a final packaging test, Packaging Test 2, was performed.

RF Test 1 was conducted using a planar near-field range. The antenna prototype was held vertically, with gravity acting in the plane of the reflectarray. The PVC cross was clamped to a fixture in the range. An X-band horn, mounted at the focal point of reflectarray, 1 m ahead of the dipole layer, was used to illuminate the array for testing. The foldable prototype produced a peak of 39.6 dB of gain at 8.4 GHz.

RF Test 2 was conducted after a stow and deploy cycle to determine the effects of folding and unfolding on the RF performance. This test was conducted following several months of storage using a vertical planar near-field range of the same general type as the one used for Test 1. The test setup was comparable to the setup for RF Test 1. The planar ranges in both testing facilities used similar hardware.

Figure 7:
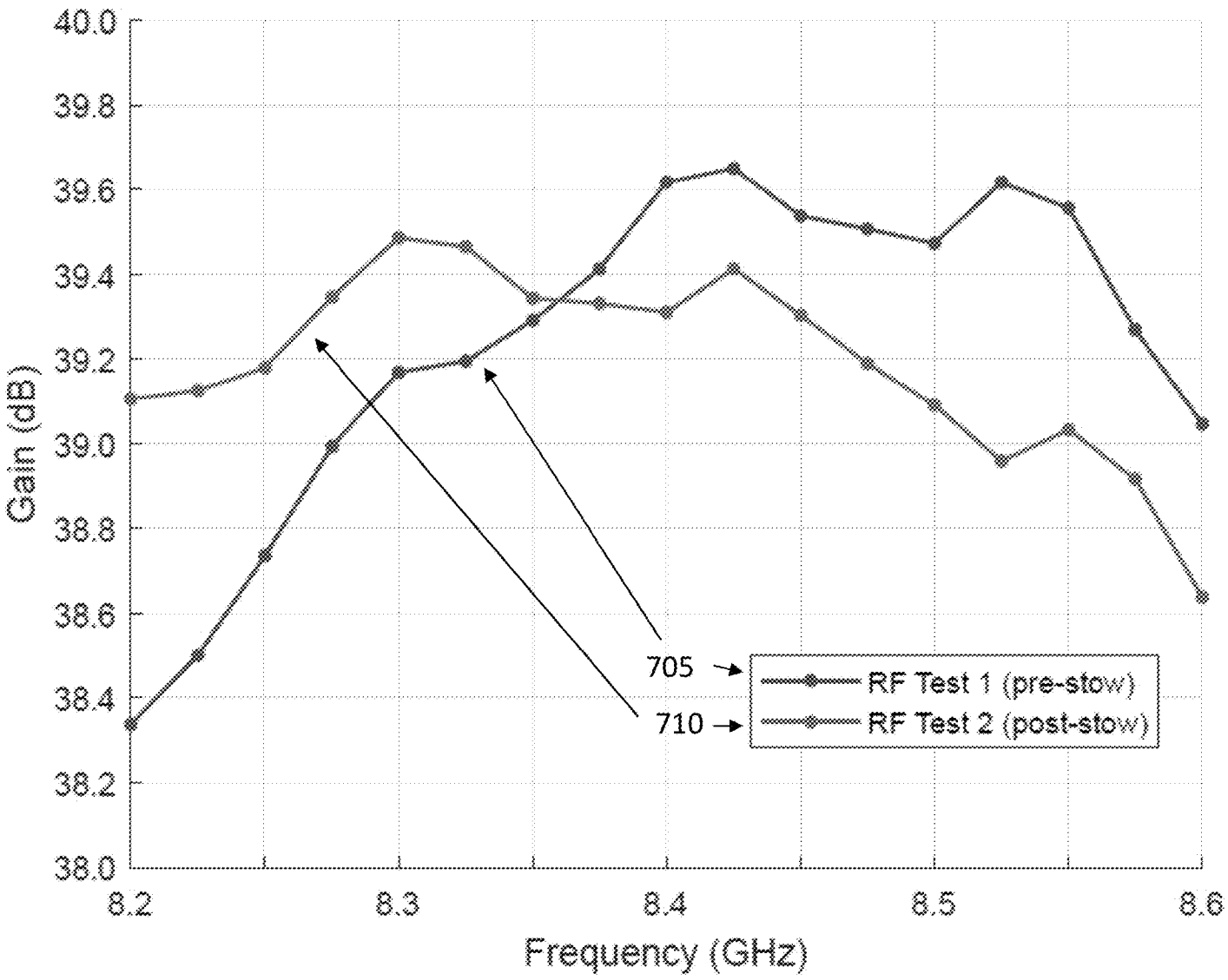
FIG. 7 shows the measured RF gain.
Figure 8:
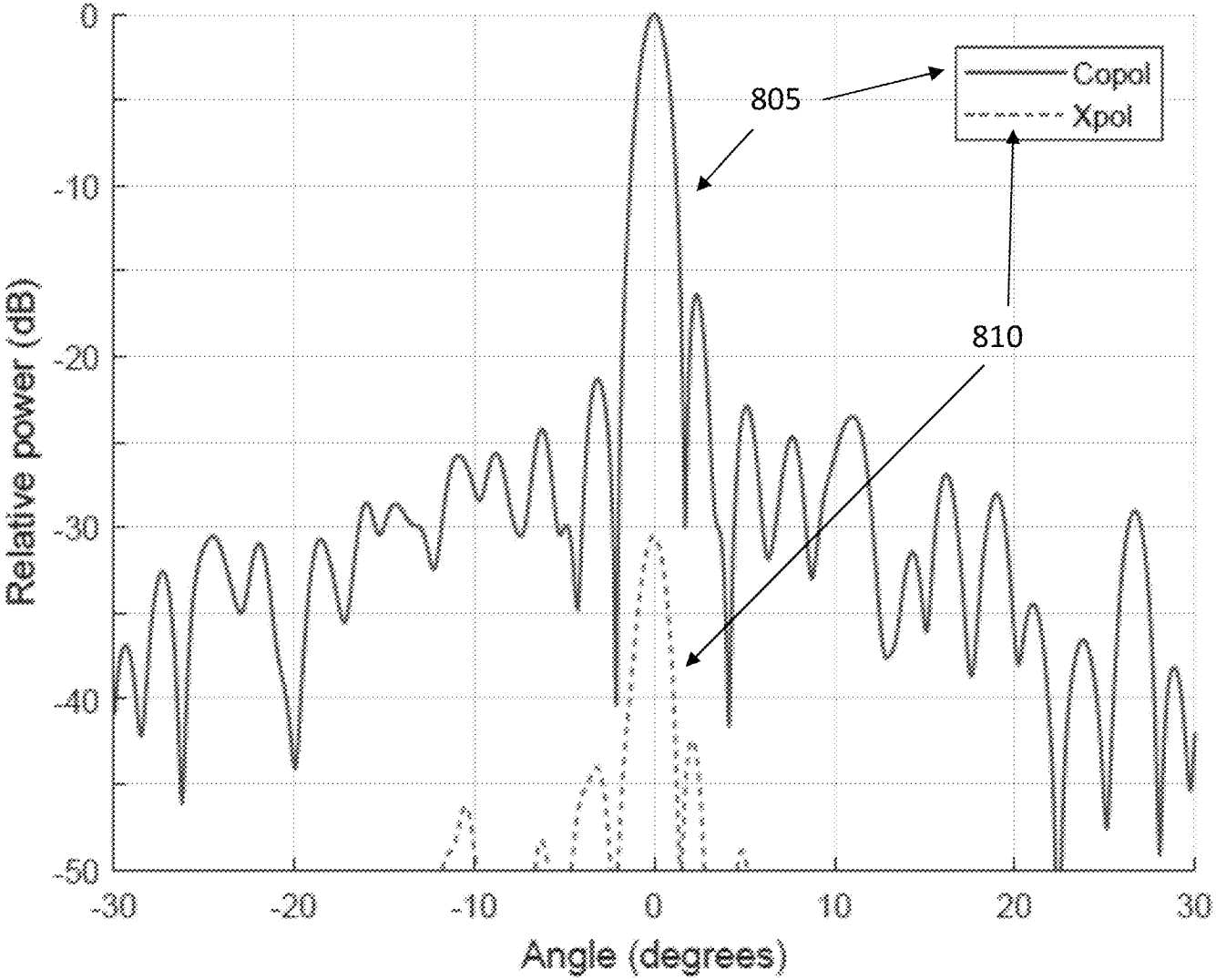
FIG. 8 illustrates the azimuth for the antenna beam pattern.
Figure 9:
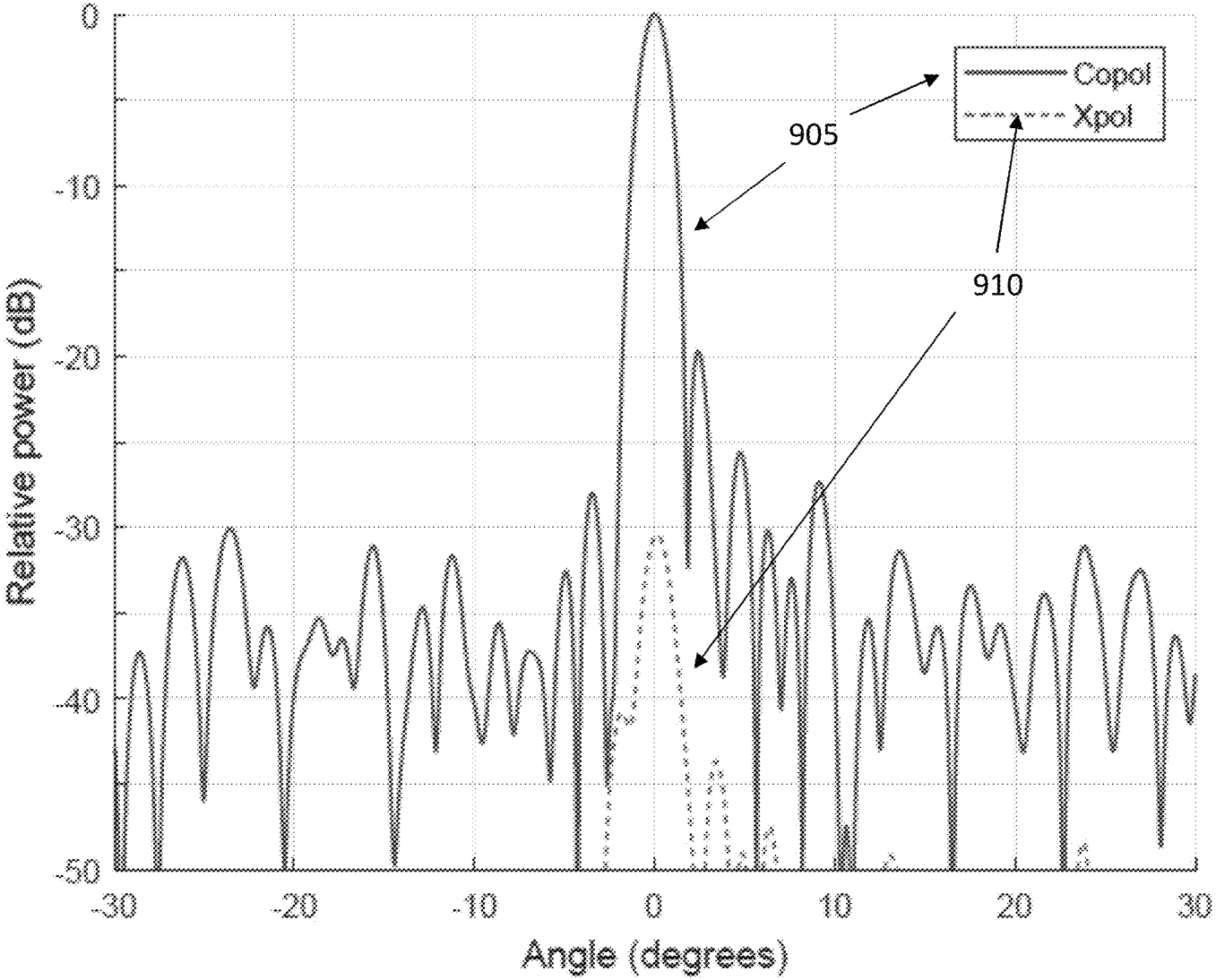
FIG. 9 illustrates the elevation for the antenna beam pattern.

FIG. 7 shows the frequency-dependent measured gain of the reflectarray for both RF tests: test 1 (705) before stowing, and test 2 (710) after stowing. As can be seen, stowing the reflectarray has very little effect on the gain produced by the antenna; the peak gain dropped by about 0.3 dB, and the peak frequency shifted by about 100 MHz. FIGS. 8-9 show the measured beam patterns from RF Test 2, with FIG. 8 plotting the azimuth values for copolarization (805) and crosspolarization (810); and FIG. 9 the elevation values for copolarization (905) and crosspolarization (910). As can be seen, the reflectarray produced a well-focused beam in both azimuth and elevation, with low sidelobe and cross-polarization levels.

Figure 10:
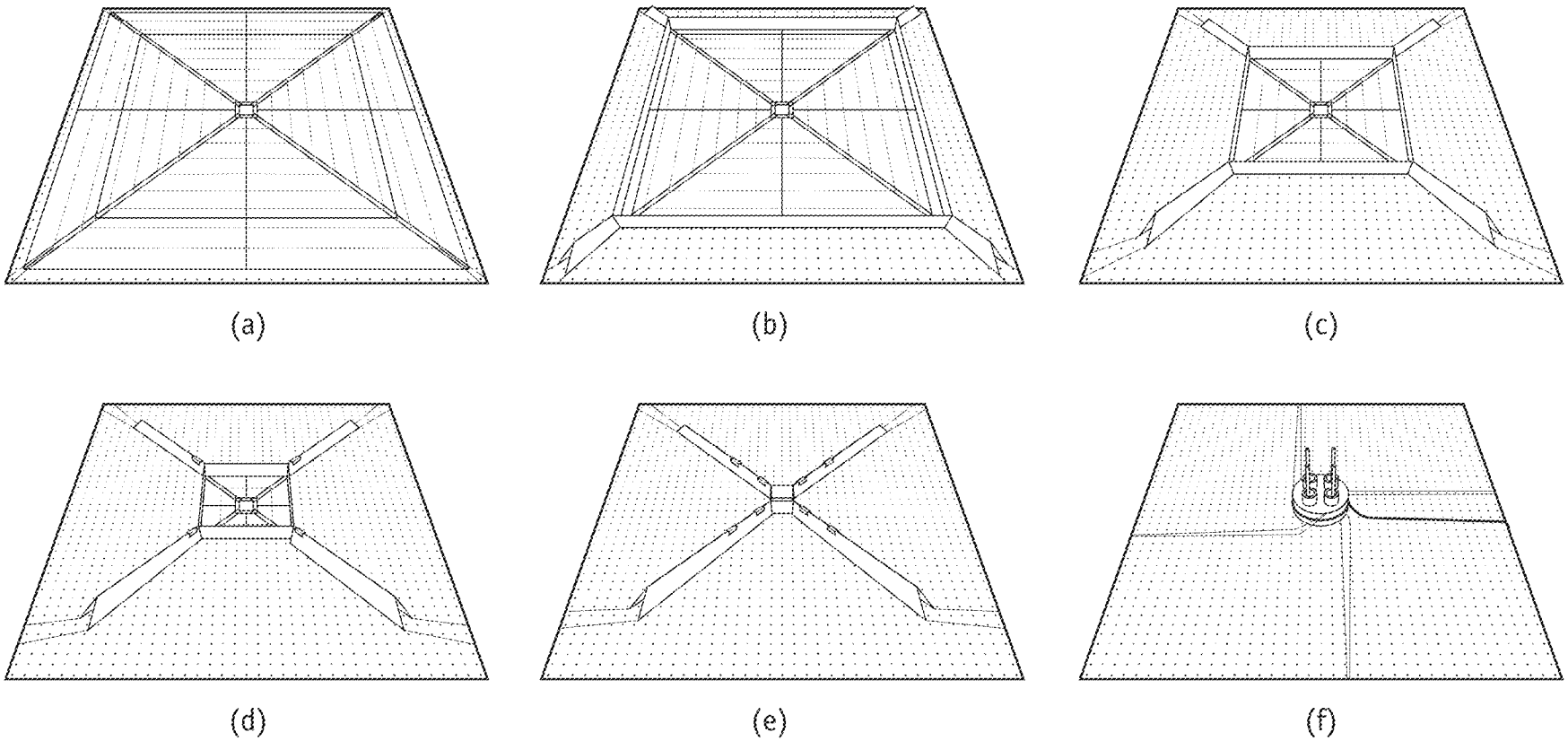
FIGS. 10-11 illustrate packaging of the reflectarray.

FIG. 10 illustrates an exemplary packaging sequence for the reflectarray. The deployed reflectarray was placed on a flat steel-top table 1.5 m in width. The strips were folded manually, following the sequence in panels a)-f). It can be seen how the strips are gradually folded from the outside in, for example in panels b) and c). During this folding process, the strips were flattened against each other. Bobby pins and large binder clips were used to hold the quadrants and the diagonals folded.

Figure 11:
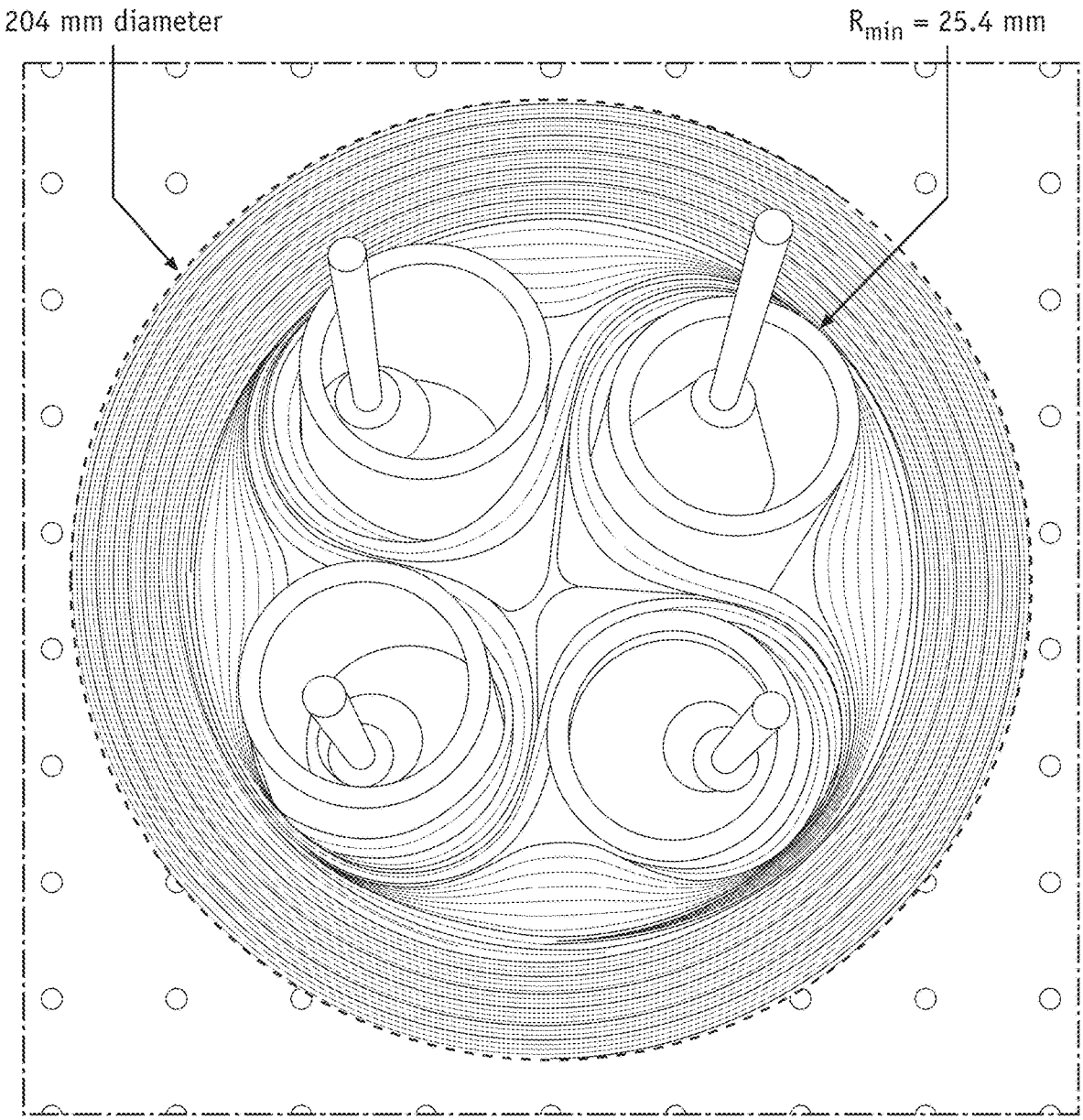

For the second step of wrapping, the star-folded reflectarray in panel e) was placed in the middle of four aluminum tubes of known outer radius. The tubes limited the maximum curvature in the wrapped reflectarray. The outer radius of these tubes was 31.75 mm for the first packaging test, and 25.4 mm for the second. These four tubes were placed a known distance apart using shoulder bolts inserted in the steel-top table. The folded reflectarray was then manually wrapped around these four tube as seen in panel f). Once fully wrapped, the wrapped array was held in place by a Velcro™ strap placed around the outer circumference of the wrapped structure. FIG. 11 shows a top view of the wrapped reflectarray after packaging.

Once wrapped, the outer circumference of the reflectarray was measured using a flexible tape measure. From this, the packaged diameter was derived to be 241 mm for the first test, and 204 mm for the second test. The packaged height was around the strip width, about 88 mm. The packaging efficiency $\eta$ of the reflectarray can be calculated as the fraction of the cylindrical packaged volume occupied by the material of reflectarray. This cylindrical packaging volume $V_{packaged}$ was taken to have a height of the strip width 88 mm, and the radius as measured. The material volume $V_{material}$ was calculated as the area of the reflectarray A times the measured flattened strip thickness h=610 micrometers. The packaging efficiency was calculated to be between 34% and 48%. By refining the packaging process, for example using a jig or automatic mechanism instead of entirely manual folding, the packaging efficiency can be improved to be higher than 30%, higher than 40% or higher than 50%.

Figure 12:
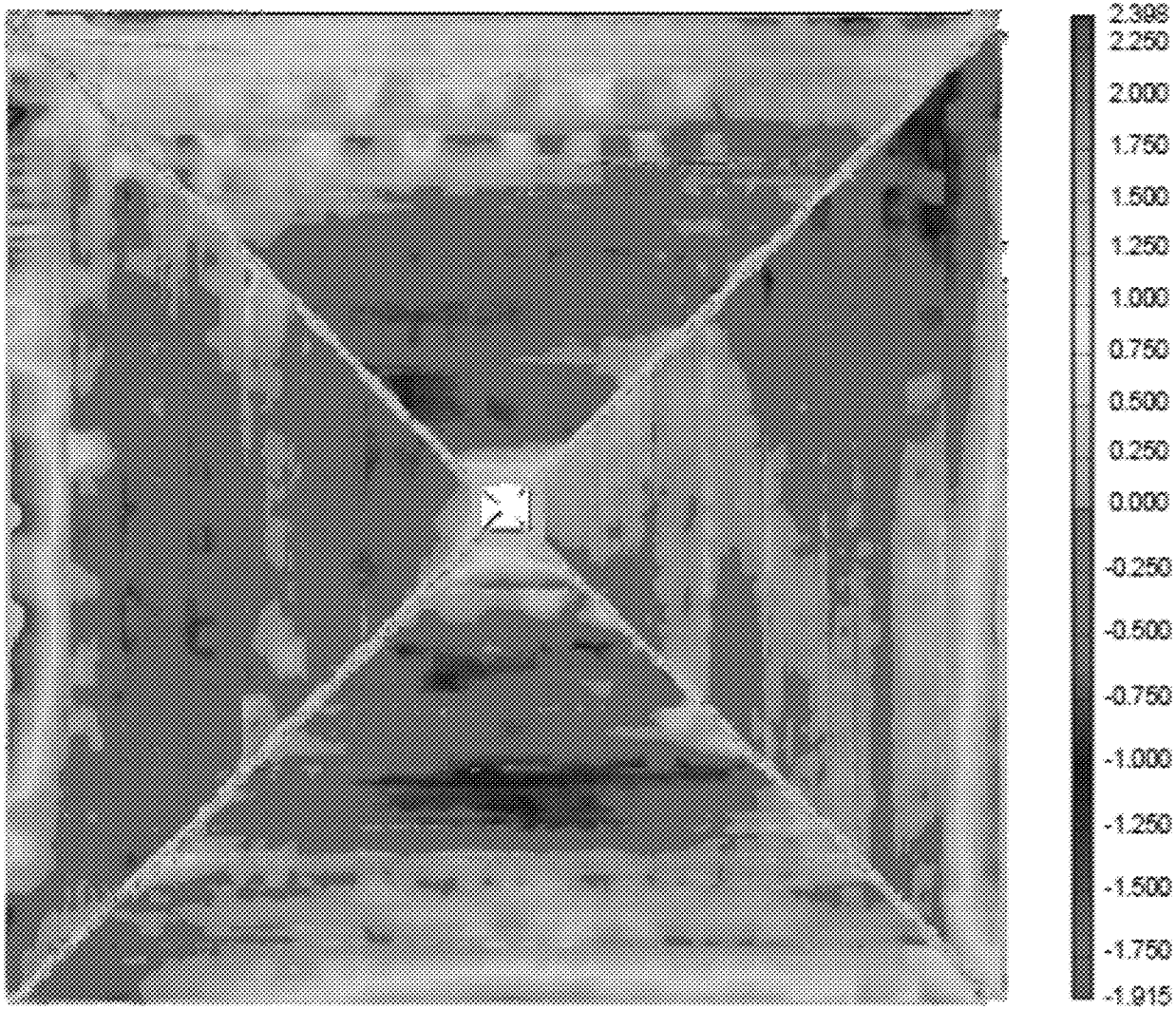
FIG. 12 illustrates surface flatness measurements for the reflectarray.

FIG. 12 illustrates surface flatness measurements for the reflectarray. The surface profile of the reflectarray was measured using a non-contact coordinate measuring machine (CMM). Specifically, a FARO arm with a laser-line scanner (which provides a measurement accuracy of roughly 50 micrometers) was used to scan the entire front surface of the deployed reflectarray. The measured surface RMS was 0.5 mm, much below the $\lambda/20$=1.78 mm surface RMS criterion generally applied to RF apertures. As can be seen, the bulk of the aplanarity of the array is concentrated on the outer edges.

The present disclosure described a large-area deployable reflectarray antenna aperture capable of providing a 1.5 m×1.5 m surface, which can stow in a compact manner in a 6U CubeSat volume. It consists of bending-stiff strips made of thin composite materials that can be flattened, folded, and wrapped. Since the strips are wrapped without permanent deformation, they can pop-up after deployment to provide separation between the reflectarray dipoles and the ground plane, and also provide increased stiffness against bending. The reflectarray itself consists of an array of crossed-dipoles. The design can also be scaled to larger aperture sizes.

In some embodiment, the plurality of strips comprises four quadrants forming a square shape, each quadrant having a triangular shape occupying a quarter of the square shape, each quadrant comprising a plurality of strips of increasing length arranged to form the triangular shape. In some embodiments, a flatness root means square variation of the reflectarray in the deployed configuration is 0.5 mm or less. In some embodiments, the dipoles and ground plane may be made of a conductive material other than copper; for example, gold or aluminum could be used. In some embodiments, the dipoles and ground plane are not attached to a carrier, but rather they are attached directly to the facesheets. In some embodiments, the first facesheet, the second facesheet, and the plurality of collapsible S-shaped springs are made of a material other than an epoxy and woven quartz fabric composite, for example they are made of a cyanate ester and unidirectional quartz composite or other thin, stiff, strong materials. In some embodiments, the ligaments are not made of polyimide, but of other materials such as polyester or carbon fibers. In some embodiments, the feed is not deployable.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The references in the present application, shown in the reference list below, are incorporated herein by reference in their entirety.

REFERENCES

[1] Warren, P. A., Steinbeck, J. W., Minelli, R. J., and Mueller, C., "Large, Deployable S-Band Antenna for a 6U Cubesat," 29th Annual AIAA/USU Conference on Small Satellites, 2015.

[2] Chahat, N. E., Hodges, R. E., Sauder, J., Thomson, M., Peral, E., and Rahmat-Samii, Y., "CubeSat Deployable Ka-Band Mesh Reflector Antenna Development for Earth Science Missions," IEEE Transactions on Antennas and Propagation, Vol. 64, No. 6, 2016, pp. 2083-2093.

[3] Arya, M., Lee, N., and Pellegrino, S., "Ultralight structures for space solar power satellites," 3rd AIAA Spacecraft Structures Conference, 2016.

[4] Arya, M., Packaging and Deployment of Large Planar Spacecraft Structures, Ph.D. thesis, California Institute of Technology, 2016.

[5] Arya, M., Lee, N., and Pellegrino, S., "Crease-free biaxial packaging of thick membranes with slipping folds," International Journal of Solids and Structures, Vol. 108, 2017, pp. 24-39.

[6] Schlothauer, A., Royer, F., Pellegrino, S., and Ermanni, P., "Flexible Silicone Molds for the Rapid Manufacturing of ultra-thin Fiber Reinforced Structures," Society for the Advancement of Material and Process Engineering (SAMPE 2018), 2018.

What is claimed is:

1. A deployable reflectarray antenna comprising:
- a plurality of deployable booms;
- a radio frequency feed; and
- a reflectarray supported by the plurality of deployable booms and configured to:
  - be stored in a folded configuration within a satellite bus, and
  - deploy out of the satellite bus into a deployed configuration during operation of the satellite, the reflectarray comprising:
  - a plurality of strips, each strip of the plurality of strips comprising:
    - a conductive ground plane;
    - a single first facesheet attached to the conductive ground plane;
    - a single second facesheet;
    - a plurality of conductive dipoles attached and common to the single second facesheet;
    - a plurality of collapsible S-shaped springs attached to the single first facesheet and to the single second facesheet, and being configured to:
    - collapse during folding of the reflectarray, thus allowing the single first facesheet and the single second facesheet to fold against each other in the folded configuration, and
    - provide mechanical support for the reflectarray in the deployed configuration by separating the single first facesheet from the single second facesheet,
- the deployable reflectarray antenna further comprising
  - two diagonally arranged tubular arrangements running along the reflectarray and dividing the reflectarray in four triangularly shaped quadrants, each tubular arrangement being connected to the plurality of strips and comprising a flexible tubing containing a cord pretensioned by the plurality of booms, the cord passing through the flexible tubing.

2. The deployable reflectarray antenna of claim 1, wherein a distance between the conductive ground plane and the plurality of conductive dipoles in the deployed configuration is 5 mm.

3. The deployable reflectarray antenna of claim 1, wherein the plurality of conductive dipoles comprises cross-dipole elements having a cross shape.

4. The deployable reflectarray antenna of claim 1, wherein each collapsible S-shaped spring of the plurality of collapsible S-shaped springs comprises three flat sections connected by two transversely curved sections, the two transversely curved sections being configured to flex during folding of the reflectarray.

5. The deployable reflectarray antenna of claim 4, wherein a radius of curvature of the two transversely curved sections in the deployed configuration is 5 mm, giving a flattening strain for the plurality of collapsible S-shaped springs of less than 1.6%.

6. The deployable reflectarray antenna of claim 1, wherein the single first facesheet and the single second facesheet, of each strip of the plurality of strips, have a fiber layup comprising two plies arranged in a 0°/90° stack, wherein 0° is defined as being along a length of each strip of the plurality of strips for that respective strip of the plurality of strips.

7. The deployable reflectarray antenna of claim 1, wherein each collapsible S-shaped spring of the plurality of collapsible S-shaped springs has a fiber layup comprising two plies arranged in a 0°/90° stack, wherein 0° is defined as being along a length of the collapsible S-shaped spring in the folded configuration.

8. The deployable reflectarray antenna of claim 1, wherein, in the deployed configuration, a gap between adjacent strips of the plurality of strips is 2 mm.

9. The deployable reflectarray antenna of claim 1, wherein a packaging efficiency of the reflectarray, calculated as a fraction of a cylindrical packaged volume occupied by the reflectarray, is greater than 30%.

10. The deployable reflectarray antenna of claim 1, wherein each strip of the plurality of strips has a width of 88 mm.

11. The deployable reflectarray antenna of claim 3, wherein the plurality of conductive dipoles comprises 4340 cross-dipole elements spaced 22.5 mm apart in a rectangular lattice.

12. The deployable reflectarray antenna of claim 1, wherein a flatness root mean square variation of the reflectarray in the deployed configuration is 0.5 mm or less.

13. The deployable reflectarray antenna of claim 1, further comprising a first polyimide carrier between the conductive ground plane and the single first facesheet, and a second polyimide carrier between the single second facesheet and the plurality of conductive dipoles.

14. The deployable reflectarray antenna of claim 1, wherein the conductive ground plane and the plurality of conductive dipoles are made of a material selected from the group consisting of: copper, gold, and aluminum.

15. The deployable reflectarray antenna of claim 1, wherein the single first facesheet, the single second facesheet, and the plurality of collapsible S-shaped springs are made of a material selected from the group consisting of: an epoxy and woven quartz fabric composite, and a cyanate ester and unidirectional quartz composite.

16. The deployable reflectarray antenna of claim 1, wherein the tubing is made of fabric.

17. The deployable reflectarray antenna of claim 1, further comprising quadrant tensioning lines at ends of said each tubular arrangement.

18. The deployable reflectarray antenna of claim 1, further comprising a plurality of ligaments joining adjacent strips of the plurality of strips.

19. The deployable reflectarray antenna of claim 18, wherein the plurality of ligaments is made of a material selected from the group consisting of: polyimide, polyester, and carbon fibers.

20. A deployable reflectarray antenna comprising:

a plurality of deployable booms;

a radio frequency feed; and a reflectarray supported by the plurality of deployable booms and configured to: be stored in a folded configuration within a satellite bus, and deploy out of the satellite bus into a deployed configuration during operation of the satellite, the reflectarray comprising:

a plurality of strips, each strip of the plurality of strips comprising:

a conductive ground plane;

a single first facesheet attached to the conductive ground plane;

a single second facesheet;

a plurality of conductive dipoles attached and common to the single second facesheet;

a plurality of collapsible S-shaped springs attached to the single first facesheet and to the single second facesheet, and being configured to:

collapse during folding of the reflectarray, thus allowing the single first facesheet and the single second facesheet to fold against each other in the folded configuration, and provide mechanical support for the reflectarray in the deployed configuration by separating the single first facesheet from the single second facesheet.

* * * * *